United States Patent [19]

Oellers et al.

[11] 4,426,753

[45] Jan. 24, 1984

[54] APPARATUS FOR OPENING AND CLEANING COTTON WASTE

[75] Inventors: Walter Oellers, Monchen-Gladbach, Fed. Rep. of Germany; Friederich Fischer, Ubach over Worms, Netherlands

[73] Assignee: Trützschler GmbH & Co. KG, Monchen-Gladbach, Fed. Rep. of Germany

[21] Appl. No.: 343,292

[22] Filed: Jan. 27, 1982

[30] Foreign Application Priority Data

Aug. 22, 1981 [DE] Fed. Rep. of Germany ... 8124640[U]

[51] Int. Cl.[3] ..... D01G 9/10

[52] U.S. Cl. ..... 19/83; 19/85; 19/200

[58] Field of Search ..... 19/83, 85, 200

[56] References Cited

U.S. PATENT DOCUMENTS

| | | | |
|---|---|---|---|
| 2,036,915 | 4/1936 | Brown et al. | 19/85 |
| 2,092,693 | 9/1937 | Brickett et al. | 19/85 |
| 3,605,196 | 9/1971 | Wise et al. | 19/83 |
| 3,894,315 | 7/1975 | Fukuta et al. | 19/83 X |
| 3,941,530 | 3/1976 | Platt | 19/83 X |

FOREIGN PATENT DOCUMENTS

| | | |
|---|---|---|
| 6702 | 2/1879 | Fed. Rep. of Germany . |
| 1685571 | 8/1971 | Fed. Rep. of Germany . |
| 2515780 | 10/1976 | Fed. Rep. of Germany . |
| 2638353 | 3/1978 | Fed. Rep. of Germany . |
| 2755380 | 1/1981 | Fed. Rep. of Germany . |

*Primary Examiner*—Louis Rimrodt

*Attorney, Agent, or Firm*—Spencer & Frank

[57] ABSTRACT

An apparatus for opening and cleaning fiber tufts, includes an opening roll, a feeding mechanism for advancing the fiber tufts to the opening roll; a screen disposed along one part of the circumferential surface of the opening roll and located downstream of the feeding mechanism, as viewed in the direction of rotation of the opening roll. The screen permits impurities, propelled by centrifugal forces, to pass therethrough. The screen is eccentric with respect to the opening roll. There is further provided a shroud disposed along one part of the circumferential surface of the opening roll and located downstream of the screen. The shroud is movably supported for assuming an open position in which fiber tufts may pass from an annular clearance between the opening roll and the screen to an outlet and a closed position in which passage of the fiber tufts is blocked from the clearance to the outlet.

12 Claims, 3 Drawing Figures

APPARATUS FOR OPENING AND CLEANING COTTON WASTE

BACKGROUND OF THE INVENTION

This invention relates to an apparatus for opening and cleaning cotton waste particularly strips, card fly, scutcher waste, comber waste, filter waste and undercard waste. The apparatus comprises a fiber feed arrangement for advancing the fiber material to an opening roll and further has a screen which is situated downstream of the feeding device in the direction of the opening roll as well as a fiber collecting bin. An apparatus of this type is disclosed, for example, in German Published Accepted Application (Auslegeschrift) No. 2,755,380.

SUMMARY OF THE INVENTION

It is an object of the invention to provide an improved apparatus of the above-outlined type in which the degree of opening and cleaning is substantially increased.

This object and others to become apparent as the specification progresses, are accomplished by the invention, according to which, briefly stated, the screen is arranged eccentrically with respect to the beater roll and further there is provided an openable and closable cover which is situated downstream of the screen in the direction of the beater roll. During operation the shroud is periodically opened to allow passage of the cleaned fiber tufts into an outlet.

The invention is based on the principle according to which a dosed quantity of waste is advanced in a narrow beater chamber with the aid of a beater roll over a large-surface screen until a predetermined pre-cleaning is achieved. Additional components such as guide plates, beater strips, work rolls, cutters, strippers or the like can be dispensed with. With the structure according to the invention the fiber tufts are opened and cleaned in a gentle manner. According to the invention, the screen is arranged eccentrically with respect to the beater roll and the space between the beater roll and the housing is very narrow and is so formed that it allows the fiber material to drift in a pulsating manner into and out of the circumscribable circle of the beater roll upon each revolution thereof, while the fiber tufts can leave the chamber only for very short periods. In this manner, during the entire cleaning interval (2 to 5 seconds) the fiber tuft material is imparted a high velocity so that the fiber tufts formed by alternating buildup are advanced over the screen and are freed from dust and cleaned continuously by centrifugal force. Since the screen and the beater roll are the only working components, the high cleaning effect of the apparatus according to the invention can be traced in particular to the advantageous configuration of the beater chamber and screen in conjunction with the intermittent operational mode. A particular advantage of the invention resides in the fact that the waste material is pre-cleaned in such a manner that it may be subsequently cleaned by means of a single beater pass to such an extent that it may be again introduced into the cleaning line without soiling the fresh cotton.

DESCRIPTION OF THE PREFERRED EMBODIMENT

Figure 1:
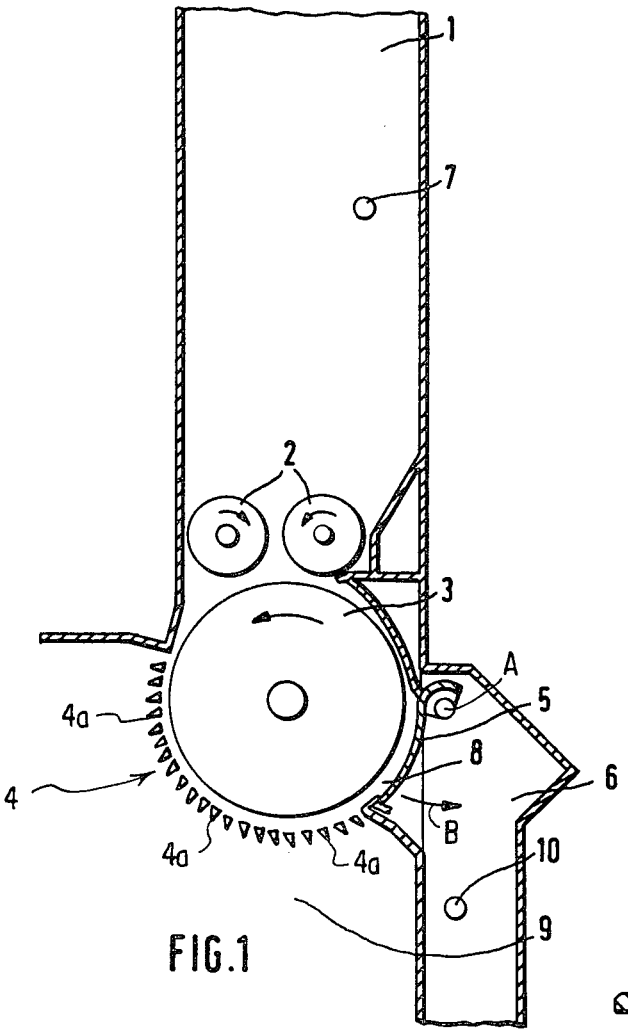
FIG. 1 is a schematic side elevational view of a preferred embodiment of the invention.
Figure 2:
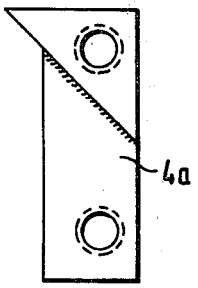
FIG. 2 is a side elevational view, on an enlarged scale, of a detail of FIG. 1.
Figure 3:
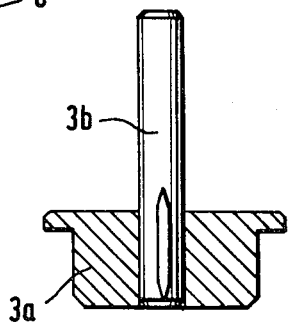
FIG. 3 is a sectional view of a detail of the structure shown in FIG. 1.

Turning to FIG. 1, there is shown a feed chute 1 into which waste material from individual machines of a cleaning line is introduced. At the lower end of the feed chute 1 there are arranged two oppositely rotating feed rolls which draw the material from the feed chute 1 and advance the material to an opening roll (beater roll) 3 arranged downstream of the feed rolls 2. The opening roll 3 which preferably has a diameter of 350–400 mm, rotates with a circumferential speed of approximately 13–15 m/sec. Along the circumference of the opening roll 3 there are arranged a plurality of strip-like supports 3*a* (FIG. 3) extending parallel to the axis of the opening roll 3. The number of the supports 3*a* is preferably between 5 and 7. Each support strip 3*a* is provided with a series of spaced pins 3*b* of circular cross section, as shown in FIG. 3. The opening roll 3 is closely surrounded by a housing which is formed in part by a screen 4 and a shroud 5. The latter may be rotatable about an axis A extending parallel to the longitudinal axis of the opening roll 3. The screen 4 is arranged eccentrically with respect to the opening roll 3 whereby the distance between the opening roll 3 and bars 4*a* forming the screen 4 increases as viewed in the direction of rotation of the opening roll 3. The surface of the screen 4 extends approximately 40–50% (that is, approximately 140°–180°) over the circumferential face of the opening roll 3. The screen bars 4*a*, shown in detail in FIG. 2, are centrally adjustable. Underneath the screen 4 there is provided a waste collecting space 9 which is at atmospheric (neutral) pressure. The shroud 5 is situated downstream of the screen 4 as viewed in the rotational direction of the opening roll 3. It may be opened in the direction of the arrow B by rotating it about the axis A. In the closed position shown in FIG. 1, the shroud 5 is a smooth (not angled) continuation of the screen 4. The height of the fiber column in the feed chute 1 is sensed by a sensor 7 which, for example, may be a photocell. The feed rolls 2 and the shroud 5 are controlled electromechanically by a timing device (not shown). By means of such a control device the collecting space 9 is periodically and automatically emptied.

In the description which follows, the operation of the above-described apparatus will be set forth.

The waste material is advanced by the feed rolls 2 to the opening roll 3 which repeatedly takes the material through the annular space 8 over the inner face of the screen 4. During this operation the shroud 5 is in its closed position as illustrated in FIG. 1. By virtue of centrifugal forces foreign bodies such as fragments or dust fly into the collecting chamber 9 through the intermediate spaces between the bars 4*a* of the screen 4. After the opening roll has performed, for example, 20 to 30 revolutions, the shroud 5 is automatically opened, whereby the pre-cleaned material is advanced into the feed (outlet) chute 6. From the feed chute 6 the material is transferred to an after-connected cleaning machine such as, for example, a Novacotonia NCA model manufactured by Trützschler GmbH Mönchengladbach, Germany. Although the entire pre-cleaning process which is performed in the chamber 8 is performed intermittently, and likewise, the feed chute 6 is charged intermittently, the charging of the feed chute 1 and the discharging of the feed chute 6 are continuous. The heights of the material column in the feed chutes 1 and 6 are regulated by an otherwise conventional control device having sensors 7 (for the feed chute 1) and 10 (for the feed chute 6). In this manner, the quantities introduced by the feed rolls 2 and the cleaning periods determined by the timing device may be set arbitrarily so that the apparatus can be adapted to different types of fiber material to be opened and pre-cleaned.

It will be understood that the above description of the present invention is susceptible to various modifications, changes and adaptations and the same are intended to be comprehended within the meaning and range of equivalents of the appended claims.

What is claimed is:

1. An apparatus for opening and cleaning cotton waste, comprising (a) an opening roll rotated in a direction of rotation;

(b) feeding means for advancing the cotton waste to the opening roll; said feeding means being spaced from said opening roll; and (c) a housing closely surrounding said opening roll along a substantial part of the circumferential surface thereof, whereby a narrow annular space between said opening roll and said housing is defined; said housing including (1) a screen disposed arcuately about one part of said circumferential surface and having a first end at a location downstream of said feeding means as viewed in said direction of rotation and a second end being downstream of said first end; said screen having, from said first end to said second end, a gradually increasing distance from said opening roll in a direction coinciding with said direction of rotation; and (2) a shroud disposed along one part of said circumferential surface and being located downstream of said second end of said screen as viewed in said direction of rotation; said shroud being movably supported for assuming an open position in which cotton material may pass from said narrow annular space to an outlet and a closed position in which passage of the cotton material from said narrow annular space is prevented; said screen forming, at said second end, a smooth transition into said shroud when said shroud is in said closed position.

2. An apparatus as defined in claim 1, wherein said opening roll has a plurality of opening elements.

3. An apparatus as defined in claim 2, wherein said opening elements comprise pins of circular cross section.

4. An apparatus as defined in claim 2, further comprising strip-like supports mounted on said opening roll; said strip-like supports carrying said opening elements and extending parallel to the longitudinal axis of said opening roll.

5. An apparatus as defined in claim 4, wherein said strip-like supports are 5 to 7 in number.

6. An apparatus as defined in claim 1, wherein said opening roll has a diameter of 350–400 mm.

7. An apparatus as defined in claim 1, wherein said screen extends approximately 180° over the circumferential face of said opening roll.

8. An apparatus as defined in claim 1, wherein said screen extends approximately 140° over the circumferential face of said opening roll.

9. An apparatus as defined in claim 1, wherein said screen is formed of a plurality of parallel-spaced bars.

10. An apparatus as defined in claim 1, further comprising a timing means for controlling said feeding means and for controlling a periodic opening and closing of said shroud.

11. An apparatus as defined in claim 1, further comprising electromechanical means for controlling said feeding means and said shroud.

12. An apparatus as defined in claim 1, wherein said outlet comprises an outlet chute; further comprising a feed chute in which the fiber tufts are advanced to said opening roll by said feeding means; and height control means for regulating the fiber tuft quantities in said feed chute and said outlet chute; said height control means comprises separate light barriers arranged in said feed chute and said outlet chute for sensing the height of fiber tufts therein.

* * * * *